US005263427A

United States Patent [19]

Yamamoto et al.

[11] Patent Number: 5,263,427

[45] Date of Patent: Nov. 23, 1993

[54] CATAMARAN

[75] Inventors: Osamu Yamamoto; Yasuhiro Kitamura; Masahiro Kishimoto, all of Kawasaki, Japan

[73] Assignee: NKK Corporation, Tokyo, Japan

[21] Appl. No.: 750,858

[22] Filed: Aug. 29, 1991

[30] Foreign Application Priority Data

Aug. 29, 1990 [JP] Japan ..... 2-227401
Mar. 8, 1991 [JP] Japan ..... 3-069223

[51] Int. Cl.[5] ..... B63B 1/10
[52] U.S. Cl. ..... 114/61; 114/274
[58] Field of Search ..... 114/61, 123, 274, 56, 114/57, 265, 283

[56] References Cited

U.S. PATENT DOCUMENTS 3,655,445 4/1972 Padwick .
4,174,671 11/1979 Seidl .

FOREIGN PATENT DOCUMENTS 809883 3/1937 France .
206974 2/1984 German Democratic Rep. ... 114/61
167582 12/1981 Japan ..... 114/61
55280 4/1982 Japan ..... 114/61
2-182594 7/1990 Japan .
1136861 12/1968 United Kingdom .

*Primary Examiner*—David M. Mitchell
*Assistant Examiner*—Stephen P. Avila
*Attorney, Agent, or Firm*—Keck, Mahin & Cate

[57] ABSTRACT

A catamaran comprises two single hulls arranged in parallel in the spaced relation to each other, and a deck for connecting the two single hulls, the single hull having a semisubmerged portion and a connecting portion for connecting the semisubmerged portion to the deck, the semisubmerged portion having a maximum width portion where the width of its vertical transverse cross section is largest at a position near the water level, the width of vertical transverse cross section of the semisubmerged portion abruptly decreases upward in the vertical direction from the maximum width portion and gradually decreases downward in the vertical direction from the maximum width portion, the semisubmerged portion having a minimum width portion where the width of vertical transverse cross section becomes smallest after it abruptly decreases upward in the vertical direction, and the width of vertical transverse cross section of the minimum width portion is 60% or less and 30% or more of the width of vertical transverse cross section of the maximum width portion.

11 Claims, 7 Drawing Sheets

CATAMARAN

BACKGROUND OF THE INVENTION

1. Field of the Invention

The present invention relates to a catamaran.

2. Description of the Related Arts

Catamarans, ships constructed so that two single hulls arranged transversely and spacedly are connected by a deck disposed above the sea level, have been publicly known. A semisubmerged catamaran is one type of catamaran. The inventors have made efforts to improve the semisubmerged catamarans, and as a result have developed a semisubmerged catamaran whose hulls oscillate less in waves and which can navigate on the waves with low required horsepower. This catamaran has been disclosed in Japanese Patent Publication Laid Open No. 182594/90. FIGS. 4, 5 and 6 show the conventional catamaran disclosed in Japanese Patent Publication Laid Open No. 182594/90. FIG. 4 is a schematic side view showing one conventional example of catamaran with an integral connecting portion.

FIG. 5 is a schematic side view showing another conventional example of catamaran with connecting portions separated into fore and aft portions. FIG. 6 is a sectional view along the plane of line 3—3. In the above two examples, two single hulls are arranged in parallel in spaced relation to each other and connected by a deck 7. Each of single hull 6 comprises a semisubmerged portion 8 and a connecting portion 9.

The width of vertical transverse cross section of semisubmerged portion 8 is largest near the water level. Hereafter, the width of vertical transverse cross section of semisubmerged portion 8 is simply called "width." The portion where the width of vertical transverse cross section of semisubmerged portion 8 is largest is called "the maximum width portion 17." The semisubmerged portion 8 is formed in a V shape in which the width decreases gradually in the vertical direction from the maximum width portion 17 to the lower end. On the other hand, the width of semisubmerged portion 8 abruptly decreases upward in the vertical direction from the maximum width portion 17. The width is smallest at the joint with the connecting portion 9. Hereafter, the portion where the width of semisubmerged portion 8 is smallest is called "the minimum width portion 18." The width of connecting portion 9 is equal to the width of the minimum width portion 18. The connecting portion 9 is formed so that its width is constant in the upward direction. The connecting portion 9 is also formed so that its width is smaller than the width of the maximum width portion 17. In addition, the connecting portion 9 is formed so that its width increases toward the deck 7 at the part where the connecting portion 9 is attached to the deck 7.

The bow portion of each single hull 6 composing catamarans 15 and 16 consists essentially of the semisubmerged portion 8. Therefore, the top surface 8*a* of bow portion of semisubmerged portion 8 is not connected to the connecting portion 9, so that the top surface 8*a* is formed by horizontal place or inclined surfaces such that an apical angle on vertical transverse cross sectional plane is about 15 degrees. In the two conventional examples shown in FIGS. 4, 5 and 6, the width of semisubmerged portion 8 composing each single hull 6 abruptly decreases upward in the vertical direction from the maximum width portion 17 near the water level, as described above. The abrupt decrease in width of semisubmerged portion 8 reduces the stability of ship when the hulls sink into the water, increasing the synchronizing period of oscillation. As a result, oscillation is reduced when the ship navigates on the head sea of short-period waves occurring frequently. Because of the abrupt decrease in width of semisubmerged portion 8 upward in the vertical direction from the maximum width portion 17 near the water level, the compulsory force of wave is reduced, resulting in a decrease in oscillation.

FIG. 7 is a schematic cross sectional view showing the third conventional example of catamaran. In this example shown in FIG. 7, the shape of bow portion of single hull 10 is similar to that of the catamaran 15 of the first example shown in FIG. 4. The bow portion 10*a* of each single hull 10 protrudes sharply in the third example shown in FIG. 7. This protruding portion easily plunges into waves, so that the forced moment from waves in the pitching direction is reduced. This may have an effect in reducing pitching. When the wave height increases, however, the compulsory force and forced moment of waves increase; therefore, pitching is possibly not always reduced. In the first and second conventional examples shown in FIGS. 4, 5 and 6, there is a problem of submergence into water of the semisubmerged portion 8 caused when the ship navigates at a high speed on the waves if the width of the minimum width portion 18 which connects the semisubmerged portion 8 to the connecting portion 9 is decreased to below a specified value.

On the other hand, if the width gradually decreases upward in the vertical direction from the maximum width portion 17 near the water level, there is a problem of much smaller effect in reducing the oscillation.

There is also another problem of no effect in reducing oscillation if the minimum width portion 18 of the semisubmerged portion 8 is positioned at a height which waves do not reach.

For the conventional catamaran described above, the bow of submerged portion plunges deeply into waves when the ship navigates at a high speed on the waves because the top surface of semisubmerged portion 8 is formed by horizontal plane or inclined surfaces such that an apical angle on vertical transverse cross sectional plane is about 15 degrees. As a result, the ship floats suddenly after plunging, which hinders navigation. It is unknown what grade of decrease in width of semisubmerged portion above the water level is effective in reducing oscillation. For some shape of submerged portion, a stable effect is not always obtained.

SUMMARY OF THE INVENTION

It is an object of this invention to provide a catamaran which does not plunge into waves even when it navigates at a high speed on the following sea and oscillates less when on the head sea.

To achieve the above object, this invention provides a catamaran comprising:

two single hulls arranged in parallel in the spaced relation to each other; and a deck for connecting the two single hulls, in which the single hull has a semisubmerged portion and a connecting portion for connecting the semisubmerged portion to the deck, the semisubmerged portion having the maximum width portion where the width of its vertical transverse cross section is largest at a position near the water level and the maximum width is larger than the width of vertical transverse cross section of the connecting portion, wherein the width of vertical transverse cross section of the semisubmerged portion abruptly decreases upward in the vertical direction from the maximum width portion and gradually decreases downward in the vertical direction from the maximum width portion, the semisubmerged portion has the minimum width portion where the width of vertical transverse cross section becomes smallest after it abruptly decreases upward in the vertical direction, and the width of vertical transverse cross section of the minimum width portion is 60% or less and 30% or more of the width of vertical transverse cross section of the maximum width portion.

DESCRIPTION OF THE PREFERRED EMBODIMENT

Figure 3:
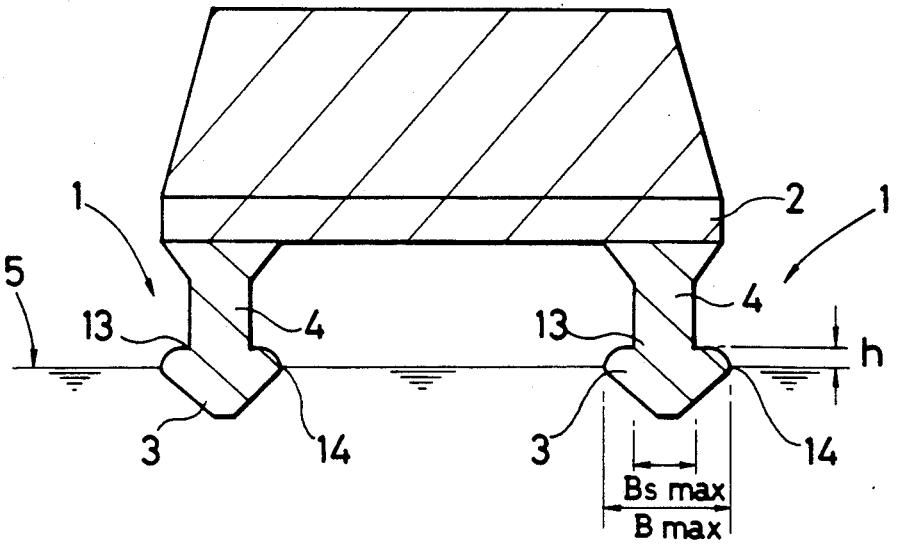
FIG. 3 is a sectional view along the plane of line 2—2 of FIG. 1 according to the present invention.
Figure 4:
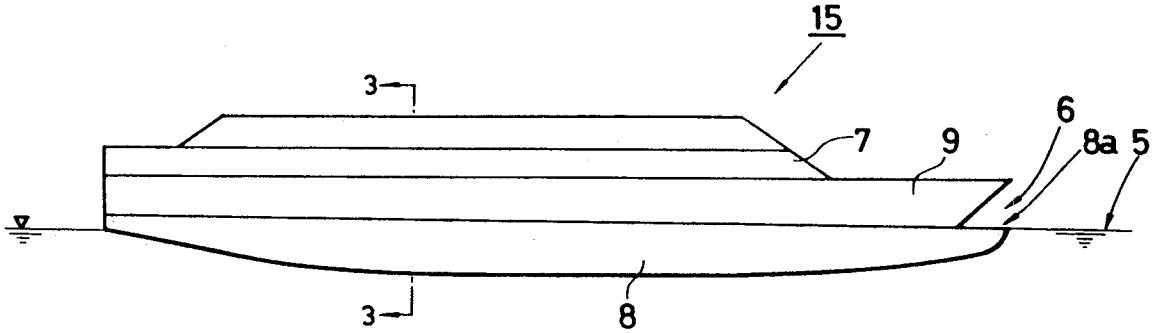
FIG. 4 is a schematic side view of the first conventional example of catamaran.
Figure 5:
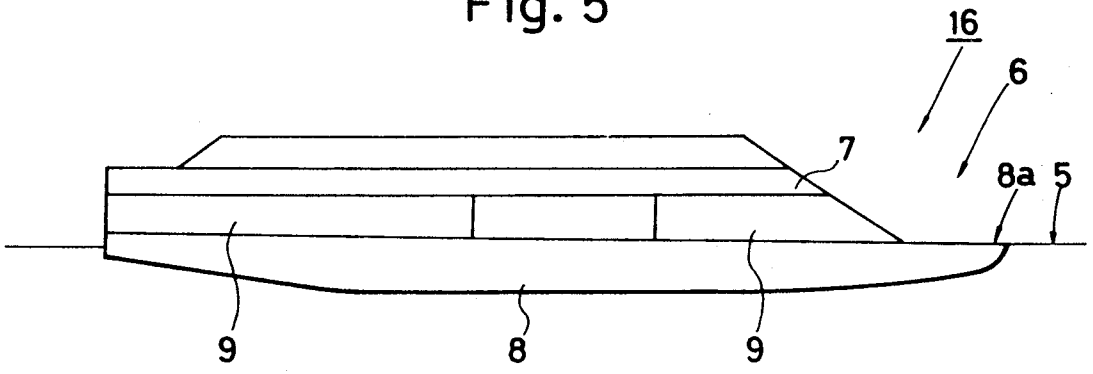
FIG. 5 is a schematic side view of the second conventional example of catamaran.
Figure 6:
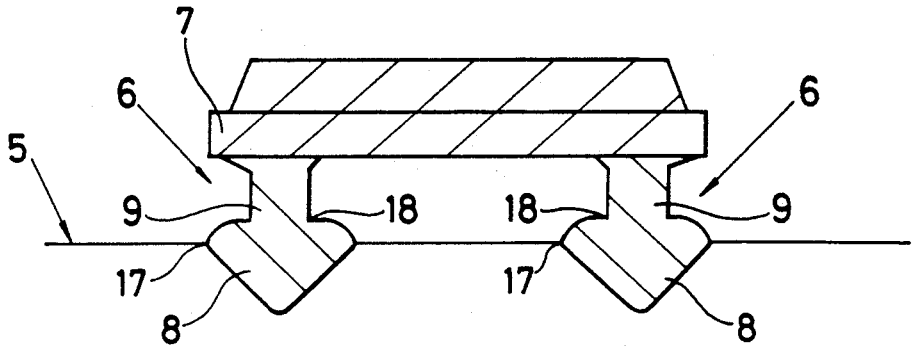
FIG. 6 is a schematic view along the plane of line 3—3 of FIG. 4 showing the first conventional example of catamaran.
Figure 7:
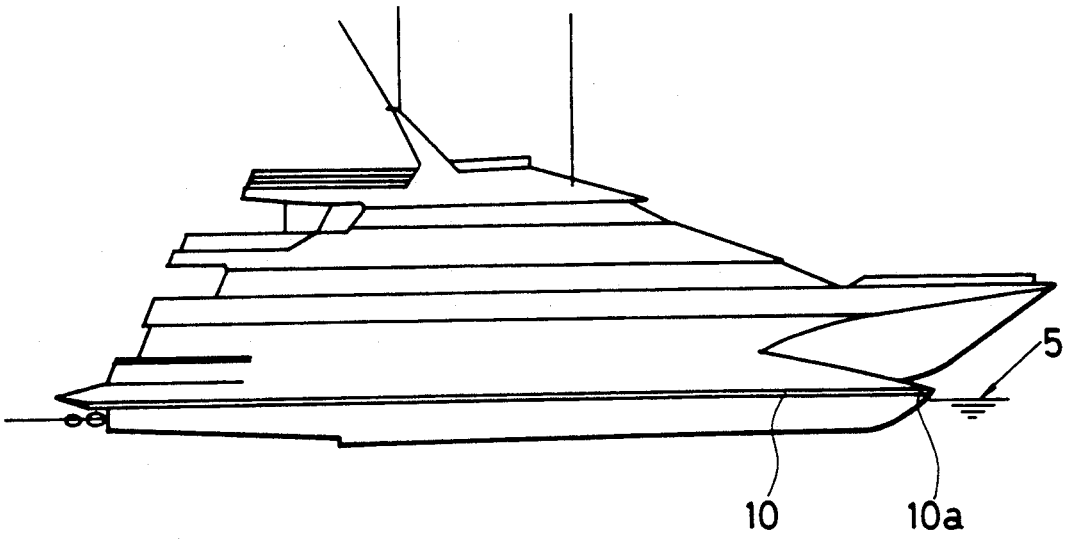
FIG. 7 is a schematic side view of the third conventional example of catamaran.

As shown in FIG. 3, two single hulls arranged spacedly are connected to each other by a deck 2. Reference numeral 5 denotes the water level. The single hull 1 is composed of semisubmerged portion 3 and a connecting portion 4 which connects the semisubmerged portion 3 to the deck 2.

The width of vertical transverse cross section of the semisubmerged portion 3 is largest near the water level. Hereafter, the width of vertical transverse cross section of the semisubmerged portion 3 is simply called "width". The portion where the width of vertical transverse cross section of the semisubmerged portion 3 is largest is called "the maximum width portion 14". The semisubmerged portion 3 is formed in a V shape in which the width decrease gradually in the vertical direction from the maximum width portion 14 to the lower end. On the other hand, the width of semisubmerged portion 3 abruptly decreases upward in the vertical direction from the maximum width portion 14. The width is smallest at the joint with the connecting portion 4. Hereafter, the portion where the width of semisubmerged portion 3 is smallest is called "the minimum width portion 13". The width of connecting portion 4 is equal to the width of the minimum width portion 13. The connecting portion 4 is formed so that its width is constant in the upward direction. The connecting portion 4 is also formed so that its width is smaller than the width of the maximum width portion 14. In addition, the connecting portion 4 is formed so that its width increases toward the deck 2 at the part where the connecting portion 4 is attached to the deck 2.

FIG. 3 is a cross sectional view along the plane of line 2—2 in which the width of the maximum width portion 14 of the semisubmerged portion 3 is largest among the widths through the bow and the stern. The width of the maximum width portion 14 of the semisubmerged portion 3 is largest at a position of line 2—2 and gradually decreases in the fore and aft direction from this position.

The letter "h" shown in FIG. 3 denotes the vertical height of the minimum width portion 13 above the water level. Bmax is the width of the maximum width portion 14 of the semisubmerged portion 3, and Bsmax is the width of the minimum width portion 13 of the semisubmerged portion 3. According to this inveniton, the ratio of Bsmax/Bmax in the range from 0.3 to 0.6. The vertical height h of the minimum width portion 13 above the water level is preferably 30% or less of Bmax.

Figure 1:
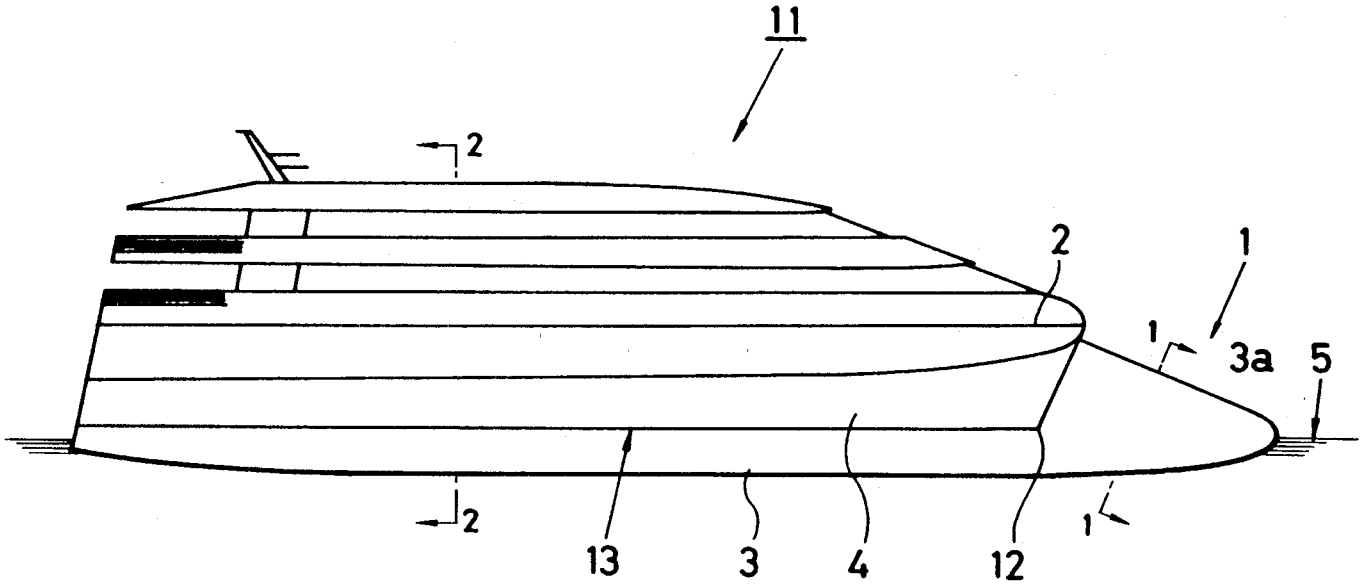
FIG. 1 is a schematic side view of a catamaran according to the present invention.
Figure 2:
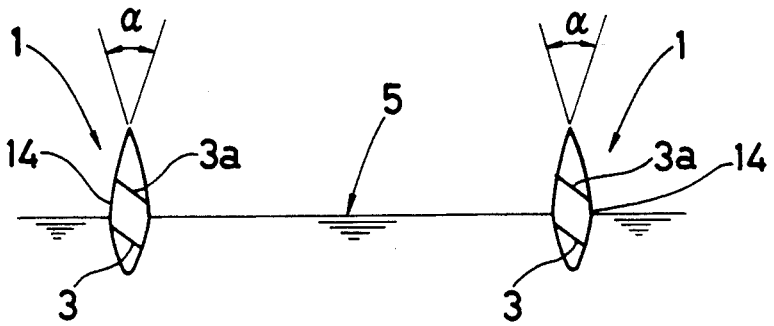
FIG. 2 is a sectional view along the plane of line 1—1 of FIG. 1 according to the present invention.

FIG. 2 is a cross sectional view perpendicular to the top line of upper bow portion **3*a* of the semisubmerged portion 3. As shown in FIG. 2, each bow portion of two single hulls 2 composing the catamaran 11 consists essentially of the semisubmerged portion 3. At the bow portion, the semisubmerged portion 3 from the maximum width portion to the lower end is formed in a V shape in which the width gradually decreases downward in the vertical direction and the semisubmerged portion 3 from the maximum width portion to the upper end is formed in a V shape in which the width gradually decreases upward in the vertical direction. The angle $\alpha$ shown in FIG. 2 is an apical angle of the semisubmerged portion 3**. The apical angle $\alpha$ is preferably than 60 degrees or less.

The bow portion of each single hull 2 consists essentially of the semisubmerged portion 3. According to this invention, this bow portion is preferably from the fore end of ship to a position of one-fifth the water line length. Therefore, the fore end 12 of connecting portion 4 is disposed at a position a specified distance apart from the fore end of the semisubmerged portion 3, namely at a position farther than the position one-fifth of water line length distant from the fore end of ship.

When the bow of the submerged portion 3 plunges into wave surface on the following sea, an oblique downward relative flow rate acts on the top surface of the upper bow portion **3*a*. As a result, a downward pressure is applied to the top surface of the upper bow portion 3*a*, so that the bow of the semisubmerged portion 3 plunges into wave surface deeply. Although an oblique downward relative flow rate inevitably acts on the top surface of the upper bow portion 3*a* when the bow of the submerged portion 3 plunges into wave surface on the following sea, the downward pressure applied to the top surface of the upper bow portion 3*a* can be reduced by changing the shape of top surface of the upper bow portion 3*a*. Specifically, if the apical angle $\alpha$ of the upper bow portion 3a of the semisubmerged portion 3 is decreased, the downward pressure applied to the top surface of the upper bow portion 3a is reduced. The downward pressure on the apical angle of 60 degrees is about one half the pressure on 180 degrees. For this reason, the apical angle $\alpha$ is preferably 60 degrees or less. When the apical angle $\alpha$ is 60 degrees or less, the bow of the semisubmerged portion 3 does not plunge into wave surface deeply on the following sea, so that the ship can navigate at a high speed stably on the following sea. For the apical angle $\alpha$ to be 60 degrees or less, the submerged portion 3 should be formed in a V shape in which its width gradually decreases upward from the maximum width portion 14, as described above. It is only the bow portion of the semisubmerged portion 3 plunging into wave surface, preferably the portion of one-fifth of the water level length from the fore end of ship, that should be formed in a V shape. This fact has been proven by a tank experiment. The shape of the aft part of connecting portion 4 in the rear of the fore end 12** is determined in terms of the effect in reducing oscillation on the head sea as described below.

At the aft part of the semisubmerged portion 3 in the rear of the fore end 12 of the connecting portion 4, the vertical height "h" of the minimum width portion 13 above the water level 5 is preferably 30% of Bmax or less. Bmax is the width of the maximum width portion 14 of the semisubmerged portion 3.

When a catamaran navigates at a high speed on the head sea, the part above the maximum width portion 14 of the semisubmerged portion 3 should be formed so that the wave crests pass through the position a specified distance above the minimum width portion 13. The pressures acting on the upper and lower surfaces of the semisubmerged portion 3 are offset; thus, both the compulsive force of wave and the stability is reduced, the oscillation also being decreased. To produce such effects, the minimum width portion 13 should be at a vertical height of about one-fourth the wave height above the water level. Assuming that the maximum wave height that allows a catamaran to navigate is one-tenth the water line length of ship and the maximum width of the semisubmerged portion 3 is one-twelfth the water line length, the vertical height "h" of the minimum width portion 13 of the semisubmerged portion 3 should be 30% or less of the maximum width of the semisubmerged portion 3.

Further, in order for such a ship form to be effective, the degree of upward decrease in width of the semisubmerged portion 3 from the maximum width portion 14 is important. The maximum value of width of the minimum width portion 13 is preferably 60% or less and 30% or more of the width of the maximum width portion 14. That is, the ratio of $Bs_{max}/B_{max}$ is in the range from 0.3 to 0.6. This decreases the compulsory force of wave by 60–30%, causing a reduction in oscillation by nearly the same degree. If the ratio of Bsmax/Bmax is less than 30%, the downward pressure acting on this part may sometimes increase when the ship runs on the waves, which may make stable high-speed running impossible. This is true particularly when the ratio of Bsmax/Bmax is not more than 20%. On the other hand, when the ratio of Bsmax/Bmax exceeds 60%, the effect in reducing oscillation cannot be expected.

Figure 8:
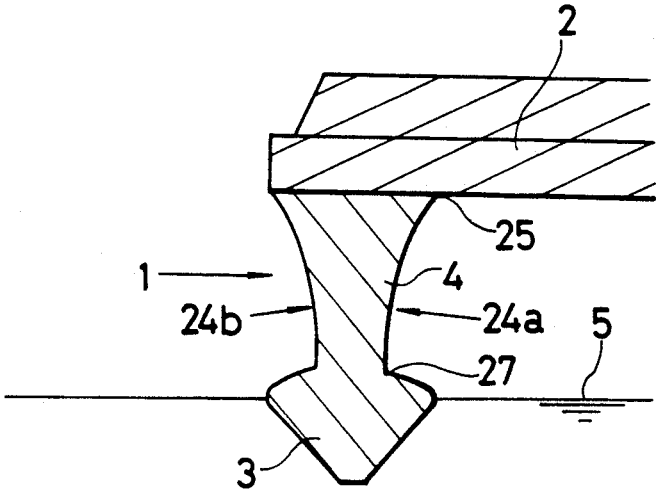
FIG. 8 is a vertical transverse cross sectional view of a connecting portion of catamaran according to the present invention.

Moreover, a study was made on a catamaran having a form in which an excessive stress concentration is not produced at the part where the connecting portion 4 is attached to the deck 2 when an external force, for example in waves, acts. FIG. 8 is a vertical transverse cross sectional view of a connecting portion 4 of this invention. As shown in FIG. 8, the width of the semisubmerged portion 3 abruptly decreases upward from the position near the water level, and gradually decreases downward. The semisubmerged portion 3 has a shape of V at its part lower than the water level. The semisubmerged portion 3 is attached to the connecting portion 4 at an attaching part 27. The connecting portion 4 is attached to the deck 2 at an attaching part 25. The width of the connecting portion 4 increases gradually from the attaching part 27 to the attaching part 25. The side surfaces 24a, 24b of the connecting portion 4 are curved in a concave form from the attaching part 27 to the attaching part 25. That is, the connecting portion is formed so that the increase in its width starts at the attaching part 27. This eliminates a discontinuous part from the vertical transverse cross section of the connecting portion 4, resulting in no excessive stress concentration at the attaching part 25 when an external force, for example in waves, acts. The width of connecting portion 4 at the attaching part 27 is smaller than the width of the semisubmerged portion 3 at the position near the water level, so that the oscillation in waves is scarcely affected.

Figure 9:
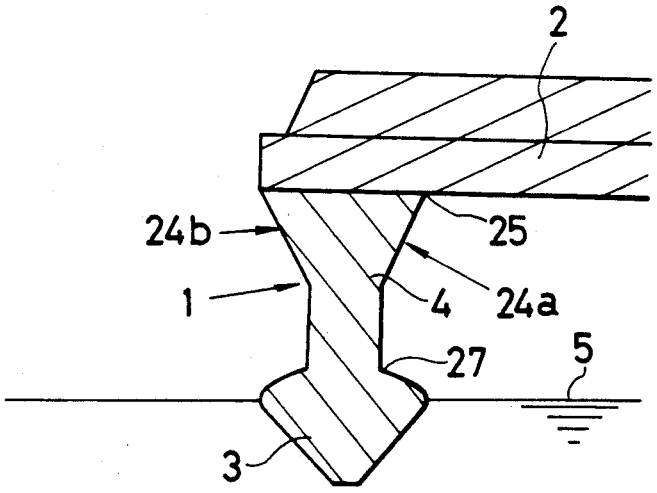
FIG. 9 is a vertical transverse cross sectional view of another connecting portion of catamaran according to the present invention.

FIG. 9 is a vertical transverse cross sectional view of another connecting portion 4 of this invention. The width of the connecting portion 4 is constant from the attaching part 27 to the middle part of the connecting portion 4. The width of the connecting portion 4 increases gradually from the middle part to the attaching part 25. The side surfaces 24a, 24b are formed by inclined planes from the middle part to the attaching part 25. This embodiment has effects similar to those of the embodiment shown in FIG. 8.

Figure 10:
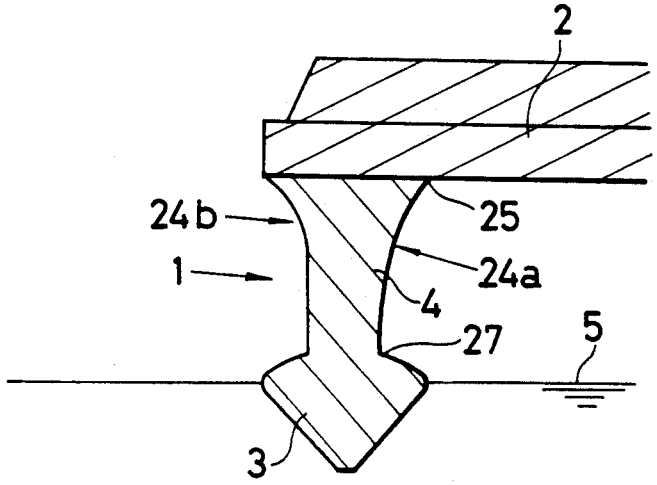
FIG. 10 is a vertical transverse cross sectional view of another connecting portion of catamaran according to the present invention.
Figure 11:
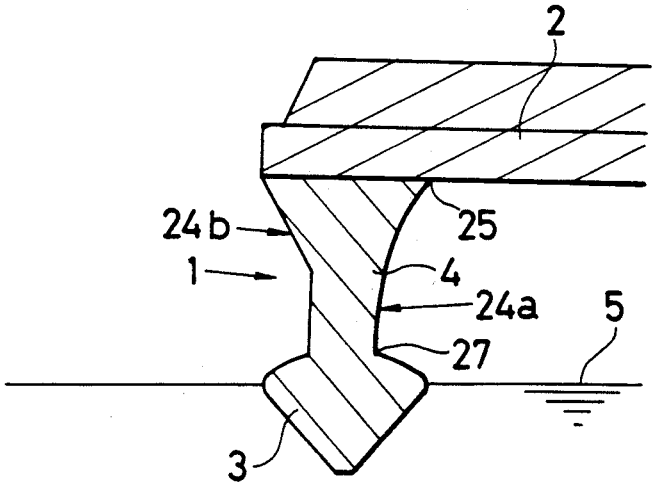
FIG. 11 is a vertical transverse cross sectional view of another connecting portion of catamaran according to the present invention.

FIG. 10 is a vertical transverse cross sectional view of another connecting portion 4 of this invention. The width of the connecting portion 4 is constant from the attaching part 27 to the middle part of the connecting portion 4. The width of the connecting portion 4 increases gradually from the middle part to the attaching part 25. The side surfaces 24a, 24b are curved in a concave form from the middle part to the attaching part 25. This embodiment has effects similar to those of the embodiment shown in FIG. 8. FIG. 11 is a vertical transverse cross sectional view of another connecting portion 4 of this invention. The inside surface 24a and the outside surface 24b of the connecting portion 4 have a different shape.

The width of the connecting portion 4 gradually increases upward from the attaching part 27 to the attaching part 25. The inside surface 24a of the connecting portion 4 is curved in a concave form from the attaching part 27 to the attaching part 25. The outside surface 24b of the connecting portion 4 is formed by a vertical plane from the attaching part 27 to the middle part, and by an inclined plane from the middle part to the attaching part 25. This embodiment also has effects similar to those of the embodiment shown in FIG. 8.

Figure 12:
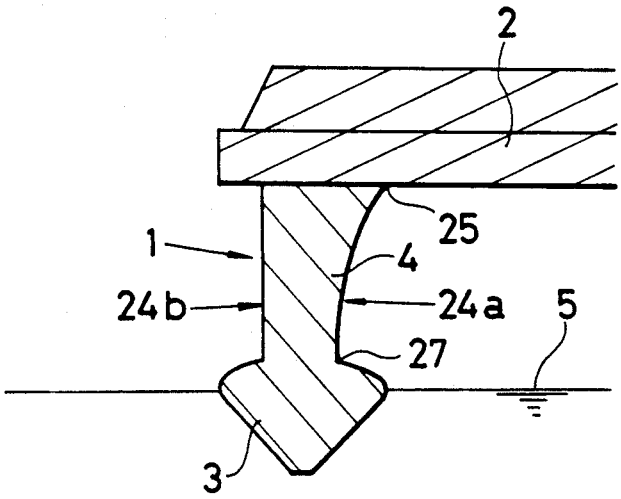
FIG. 12 is a vertical transverse cross sectional view of another connecting portion of catamaran according to the present invention.

FIG. 12 shows a connecting portion 4 whose outside surface 24b is formed by a vertical plane. The inside surface 24a is curved in a concave form from the attaching part 27 to the attaching part 25. The inside surface 24a may be formed by a vertical plane from the attaching part 27 to the middle part and by a curved concave surface or an inclined plane from the middle part to the attaching part 25. Instead of the outside surface 24*b*, the inside surface 24*a* may be formed by a vertical plane.

What is claimed is:

1. A catamaran comprising:

two single hulls arranged in parallel in spaced relation to each other;

a deck for connecting said two single hulls;

each said single hull having a semisubmerged portion and a connecting portion for connecting said semisubmerged portion to the deck;

said submerged portion and a connecting portion for connecting said semisubmerged portion having a maximum width portion where the width of its vertical transverse cross section is largest at a position near the water level, wherein the width of the vertical transverse cross section of said semisubmerged portion abruptly decreases upward in the vertical direction from the maximum width portion and gradually decreases downward in the vertical direction from the maximum width portion, said connecting portion having an attaching part for attaching said connecting portion to said deck and an attaching part for attaching said connecting portion to said semisubmerged portion, and said attaching part for attaching to said deck having a larger width than said attaching part for attaching to said semisubmerged portion;

said semisubmerged portion having a minimum width portion where the width of the vertical transverse cross section becomes smallest after it abruptly decreases upward in the vertical direction; and said width of the vertical transverse cross section of said minimum width portion being about 30 to 60% of the width of the vertical transverse cross section of said maximum width portion.

2. The catamaran according to claim 1, wherein said minimum width portion has a vertical height 30% or less of the maximum width of vertical transverse cross section above the water level.

3. The catamaran according to claim 1, wherein said single hull has a bow portion consisting essentially of the semisubmerged portion, said semisubmerged portion has width of vertical transverse cross section decreasing gradually upward in the vertical direction from the maximum width portion above water level and decreasing gradually downward below the water level.

4. The catamaran according to claim 3, wherein said bow portion is from the fore end of ship to a portion of one fifth the water line length.

5. The catamaran according to claim 3, wherein said semisubmerged portion above the water level has an apical angle of vertical transverse cross section of 60 degrees or less.

6. The catamaran according to claim 1, wherein the width of said connecting portion increases gradually from said attaching part for attaching to said semisubmerged portion to said attaching part for attaching to said deck.

7. The catamaran according to claim 6, wherein said connecting portion has a concave curved side surface such that the width of vertical transverse cross section of said connecting portion increases gradually from said attaching part for attaching to said semisubmerged portion to said attaching part for attaching to said deck.

8. The catamaran according to claim 1, wherein the width of said connecting portion increases gradually from the middle part in the height direction of connecting portion to said attaching part for attaching to said deck.

9. The catamaran according to claim 8, wherein said connecting portion has an inclined plane side surface such that the width of vertical transverse cross section of said connecting portion increases gradually from the middle part in the height direction of connecting portion to said attaching part for attaching to said deck.

10. A catamaran comprising:

two single hulls arranged in parallel in spaced relation to each other;

a deck for connecting said two single hulls;

each said single hull having a semisubmerged portion and a connecting portion for connecting said semisubmerged portion to the deck;

said submerged portion and a connecting portion for connecting said semisubmerged portion having a maximum width portion where the width of its vertical transverse cross section is largest at a position near the water level, wherein the width of the vertical transverse cross section of said semisubmerged portion abruptly decreases upward in the vertical direction from the maximum width portion and gradually decreases downward in the vertical direction from the maximum width portion, said semisubmerged portion having a minimum width portion where the width of the vertical transverse cross section becomes smallest after it abruptly decreases upward in the vertical direction; and said width of the vertical transverse cross section of said minimum width portion being about 30 to 60% of the width of the vertical transverse cross section of said maximum width portion;

wherein said connecting portion has an attaching part for attaching said connecting portion to said deck and an attaching part for attaching said connecting portion to said semisubmerged portion, said attaching part for attaching to said deck having a larger width than said attaching part for attaching to said semisubmerged portion, the width of said connecting portion increasing gradually from the middle part in the height direction of the connecting portion to said attaching part for attaching to said deck; and wherein said connecting portion has a concave curved side surface such that the width of a vertical transverse cross section of said connecting portion increases gradually from the middle part in the height direction of a connecting portion to said attaching part for attaching to said deck.

11. A catamaran comprising:

two single hulls arranged in parallel in spaced relation to each other;

a deck for connecting said two single hulls;

each said single hull having a semisubmerged portion and a connecting portion for connecting said semisubmerged portion to the deck;

said submerged portion and a connecting portion for connecting said semisubmerged portion having a maximum width portion where the width of its vertical transverse cross section is largest at a position near the water level, wherein the width of the vertical transverse cross section of said semisubmerged portion abruptly decreases upward in the vertical direction from the maximum width portion and gradually decreases downward in the vertical direction from the maximum width portion, said semisubmerged portion having a minimum width portion where the width of the vertical transverse cross section becomes smallest after it abruptly decreases upward in the vertical direction; and said width of the vertical transverse cross section of said minimum width portion being about 30 to 60% of the width of the vertical transverse cross section of said maximum width portion, wherein said connecting portion has a vertical plane side surface from said attaching part for attaching to said semisubmerged portion to said attaching part for attaching to said deck and a concave curved side surface from said attaching part for attaching to said semisubmerged portion to said attaching part for attaching to said deck.

* * * * *